US007474188B2

(12) United States Patent
Bruzy et al.

(10) Patent No.: US 7,474,188 B2
(45) Date of Patent: Jan. 6, 2009

(54) 40° PHASE-SHIFTING AUTOTRANSFORMER

(75) Inventors: Christophe Bruzy, Chatou (FR); Francis Blanchery, Chatou (FR); Gérard Monroy, Beaumont sur Oise (FR)

(73) Assignee: Thales, Neuilly sur Seine (FR)

( * ) Notice: Subject to any disclaimer, the term of this patent is extended or adjusted under 35 U.S.C. 154(b) by 0 days.

(21) Appl. No.: 11/579,064

(22) PCT Filed: Mar. 21, 2005

(86) PCT No.: PCT/EP2005/051304

§ 371 (c)(1),
(2), (4) Date: Sep. 6, 2007

(87) PCT Pub. No.: WO2005/109457

PCT Pub. Date: Nov. 17, 2005

(65) Prior Publication Data

US 2008/0130320 A1 Jun. 5, 2008

(30) Foreign Application Priority Data

May 7, 2004 (FR) ..... 04 04955

(51) Int. Cl.
*H01F 21/02* (2006.01)

(52) U.S. Cl. ..... 336/148

(58) Field of Classification Search ..... 336/5, 336/11, 12, 137, 148; 363/148–156
See application file for complete search history.

(56) References Cited

U.S. PATENT DOCUMENTS 5,619,407 A 4/1997 Hammond
6,191,968 B1 2/2001 Paice
6,335,872 B1 * 1/2002 Zhou et al. ..... 363/154
6,525,951 B1 * 2/2003 Paice ..... 363/154
6,861,936 B2 * 3/2005 Kamath ..... 336/148

OTHER PUBLICATIONS

Database WPI Section EI, Week 198116, Derwent Publications Ltd., London GB; AN 1981-D5475D XP002308108 & SU 748 728 B (Petlyakov A I), Jul. 17, 1080, figures 4, 7.

* cited by examiner

*Primary Examiner*—Tuyen T. Nguyen
(74) *Attorney, Agent, or Firm*—Lowe Hauptman Ham & Berner, LLP

(57) ABSTRACT

The invention relates to an autotransformer for transforming a three-phase power supply into a nine-phase power supply, notably for use in a rectifier. The autotransformer is a, step-up or step-down transformer. For a step-down application, the three-phase input terminals E1, E2, E3. are connected to one of the three main windings in delta configuration, mounted on respective magnetic branches M12, M23, M31 of a magnetic circuit. Te main winding B12 of one branch has intermediate taps K1, K'1, K"1 from which auxiliary windings X31, Y23, Z31, mounted on the other branches, start. These auxiliary windings produce, on three output terminals A1, B1, C1, voltages one of which is in phase with the three-phase supply voltage at E1, the other phase-shifted by +40°, and the third by +80°. The number of turns in the auxiliary windings and the position of the intermediate taps are calculated so as to obtain this result. The identical windings of the other branches produce the other output voltages on the terminals A2, B2, C2, A3, B3 in order to produce a system with nine phases.

20 Claims, 6 Drawing Sheets

40° PHASE-SHIFTING AUTOTRANSFORMER

RELATED APPLICATIONS

The present application is based on, and claims priority from, France Application Number PCT/EP2005/051304, filed May 7, 2004, the disclosure of which is hereby incorporated by reference herein in its entirety.

FIELD OF THE INVENTION

The invention relates to autotransformers used notably for the conversion of alternating (AC) electrical energy into continuous energy (DC).

BACKGROUND OF THE INVENTION

AC/DC conversion starting from a three-phase line supply current employs rectifier bridges; in theory, a single bridge with two times three diodes would suffice for rectifying three-phase current into DC current, but in practice, the use of a single bridge powered by the three-phase supply produces a DC current with too large a residual oscillation (ripple), which is unacceptable for many applications. Moreover, the rectification causes a re-injection of currents back into the supply, these currents having harmonics of the frequency of the AC supply current. This re-injection of harmonics is unacceptable if it is too large.

In order to reduce the residual ripple on the DC current and the harmonics injected back into the supply, increasing the number of phases in the supply current and the number of rectifier bridges has already been proposed. Thus, the three-phase system, whose three phases are separated by 120°, may typically be transformed into a system with nine phases separated by 40° which can be considered as a system of three three-phase supplies separated from one another by 40°. Three bridges with six diodes are used, each bridge being powered by one of these supplies. These AC/DC converters with eighteen diodes are also called 18-pulse converters. The residual ripple becomes small, as do the re-injected harmonics. The nine phases are generated using transformers. Autotransformers can be used in order to reduce the weight and dimensions, if there is no constraint on the isolation between the potentials on the line supply side and the potentials on the application side.

The U.S. Pat. No. 5,124,904 describes an 18-pulse converter. The DC voltage obtained from this nine-phase system is higher than that which would be obtained from three phases for various reasons including the fact that the residual ripple is smaller and the DC voltage depends on the mean value of the residual ripple. For reasons of equipment compatibility for example (imposed three-phase voltage, DC voltage of imposed use), this modification of DC voltage level may be undesirable when the rectification using 6 diodes is replaced with an 18-diode rectification. In order to avoid ending up with a higher DC voltage than that which would be produced by a simple three-phase rectification (for the same value of three-phase supply voltage), additional means for reducing the voltage must be provided in the autotransformer. In the U.S. Pat. No. 5,124,904, one embodiment provides these means in the form of additional windings which increase the complexity and the weight, together with the leakage reactance ratio.

The U.S. Pat. No. 5,619,407 proposes a different solution for reducing the DC voltage delivered at the output of the rectifier bridges. This solution does not use additional windings, but it is still unsatisfactory since it results in a non-symmetrical autotransformer structure; this lack of symmetry leads to harmonic distortion and therefore too great a re-injection of harmonics back into the line supply; this distortion is more significant the greater the percentage of reduction in voltage (percentage with respect to the DC voltage that would be delivered by the simple three-phase rectification).

Moreover, the systems described hereinabove do not provide a solution for increasing the DC voltage with respect to that which would be produced by a simple three-phase rectification with six diodes. In fact, there are cases where it can be desirable to increase the DC voltage rather than reduce it.

There is therefore a need for an improved autotransformer which converts a three-phase power supply into a system with nine phases that allows a desired level of DC voltage to be chosen (higher or lower than that which would be produced by a simple three-phase rectification), while at the same time maintaining a low harmonic distortion, and limiting the weight and dimensions of the autotransformer.

SUMMARY OF THE INVENTION

According to the invention, a step-up or step-down autotransformer is provided, designed to be connected to a supply of three-phase voltage of given amplitude and supplying nine output voltages with phases separated in steps of 40° and of identical amplitudes, lower or higher than the amplitude between neutral and phase of the three-phase supply; the autotransformer comprises a magnetic core with three branches and on each magnetic branch a main winding having a first and second terminal, the three main windings being electrically connected together in delta configuration. The autotransformer also comprises, on each magnetic branch, three auxiliary windings, the main winding of a given branch having between its first and its second terminal, a first, a second and a third intermediate tap, the first auxiliary winding of another branch having a first terminal connected, respectively, to a first intermediate tap of the main winding of the given branch and a second input or output terminal having a voltage in phase with the voltage present on the first terminal of this main winding, the second and third auxiliary windings of the given branch each having a first terminal connected to a second or a third intermediate tap of one or the other of the other branches and a second terminal forming a respective output amongst nine outputs of the autotransformer.

It should be noted, as will be explained in more detail herein below, that the phase of the voltage on the second terminal of an auxiliary winding is determined by the position of the intermediate tap to which this winding is connected, by the number of turns in the auxiliary winding and by the choice of the magnetic branch on which this winding is placed.

The configuration can be as follows: the first auxiliary winding of a first branch is connected to the first intermediate tap of the main winding of a second branch, the first terminal of the main winding of the second branch being connected to the second terminal of the main winding of the first branch.

In the case where the autotransformer steps down the voltage, the first and second terminals of the main windings form inputs of the autotransformer, designed to be supplied by the three-phase voltage to be transformed, and the second terminal of the first auxiliary winding of one branch forms a direct output of the autotransformer, in phase with a voltage on one terminal of the three-phase supply.

Preferably, by considering that two main windings mounted on two different magnetic branches are connected, owing to the delta configuration, to one input of the autotransformer, the auxiliary winding connected to the direct output in phase with the three-phase voltage present at this input is mounted on the third magnetic branch.

In the case where the autotransformer steps up the voltage, the first and second terminals of the main windings form direct outputs of the autotransformer, in phase with the voltages of the three-phase supply, and the second terminal of the first auxiliary winding of each branch forms a respective input of the three-phase supply.

Here again, preferably, by considering that two main windings, mounted on two different magnetic branches, are connected to the same direct output of the autotransformer in the delta configuration, the auxiliary winding connected to one input in phase with this output is mounted on the third magnetic branch.

The invention also provides an AC/DC converter which uses_an autotransformer such as is defined hereinabove, a forward-biased diode being connected between each output of the autotransformer and a positive output of the converter and a reverse-biased diode being connected between each output of the autotransformer and a negative output of the converter. In this converter, inter-phase inductors do not need to be inserted between each group of three diodes and a respective output of the converter, as is the case in certain configurations of the prior art.

BRIEF DESCRIPTION OF DRAWINGS

Other features and advantages of the invention will become apparent upon reading the detailed description that follows which is presented with reference to the appended drawings, in which.

DETAILED DESCRIPTION OF THE DRAWINGS

Firstly, a few general principles will be recalled.

Figure 1:
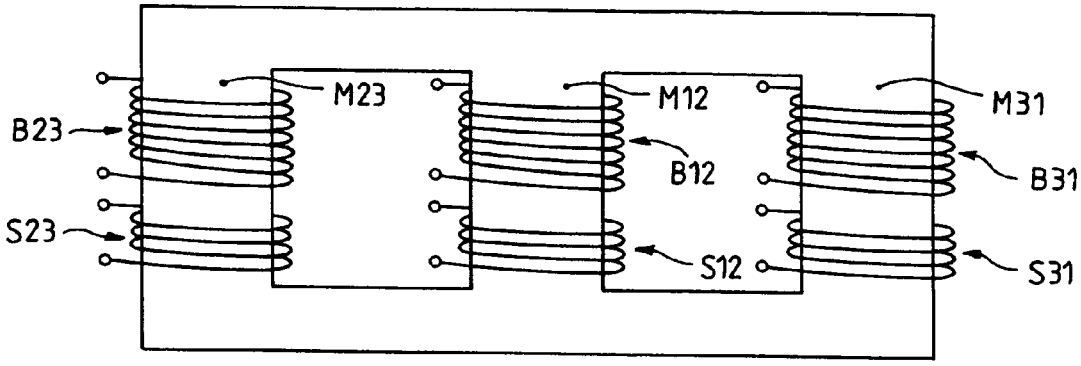
FIG. 1 shows a simplified schematic view of a transformer with three magnetic branches designed for a three-phase application.

In FIG. 1, the conventional principle of a three-phase transformer is recalled which is formed by windings disposed around branches of a triple closed magnetic circuit. The triple closed magnetic circuit comprises a ferromagnetic core with a central branch M12 that receives the windings corresponding to a first phase, and two lateral branches M23 and M31, connected to the central branch at either end of the latter, that receive the windings of a second and of a third phase, respectively. The central branch M12 and one of the lateral branches form a first closed magnetic circuit; the central branch and the other lateral branch form a second closed magnetic circuit; the two lateral branches M23 and M31 form a third closed magnetic circuit.

Several windings are wound on each branch, some forming transformer primaries and others forming secondaries. The configuration is identical for the three branches, in other words the windings playing the same role on the various branches comprise the same number of turns and are wound in the same sense.

By way of simplified circuit diagram, a respective main winding B12, B23, B31 and a respective auxiliary winding S12, S23, S31 have been shown in FIG. 1 on each branch of the magnetic core. The windings of the same magnetic branch have the same magnetic flux flowing through them. For convenience of representation, the auxiliary windings are shown next to the main windings, whereas in reality the two windings are disposed at the same location (one wound around the other, or even with the layers of one interspersed between the layers of the other) in order to have exactly the same magnetic flux flowing through them.

In the simplest imaginable connection scenario, transforming a three-phase voltage into another three-phase voltage, the main windings could be primary windings of a transformer and the auxiliary windings would be secondary windings. The primary windings could be connected in a delta or 'Y' configuration for receiving the three-phase voltage to be converted. The secondary windings would also be connected either in a delta or 'Y' configuration for producing a three-phase voltage. The magnetic fluxes flowing in the three branches are identical but phase-shifted by 120° with respect to one another. In the construction of a transformer converting a three-phase voltage into a voltage with nine phases, the configuration is more complex and uses a greater number of windings as will be seen, but the principle of a magnetic circuit with three symmetrical branches is conserved in which the magnetic fluxes of the various branches are phase-shifted by 120° with respect to one another and in which the windings of the same branch all have the same magnetic flux flowing through them.

Across the terminals of a secondary winding of a magnetic branch a voltage is present that is in phase with the voltage across the terminals of the primary winding of the same branch. The voltage generated within the secondary winding depends

- on the value of voltage across the terminals of the associated primary,
- on the ratio between the number of turns in the primary and in the secondary,
- and on the direction of rotation of the current within the turns of the secondary winding relative to the direction of the current within the primary winding (the phase of the voltage is reversed if the directions are reversed).

For a transformer with isolation between potentials on the primary and potentials on the secondary, the terminals of the secondary windings are not connected to the terminals of the primary windings or to other circuit elements on the primary side. For an autotransformer (transformer without isolation), the terminals of the secondary windings may be connected to the terminals of the primary windings or to intermediate taps formed in the primary windings. The invention relates to autotransformers.

The principle of vector representation will now be explained which allows the operation of a more complex transformer, and notably of an autotransformer capable of delivering nine secondary phases starting from three primary supply phases, to be described.

The phase and the amplitude of the voltage (single-ended voltage present at one point of the circuit or differential voltage present between two points of the circuit) can be represented by a vector whose length represents the amplitude of the AC voltage (single-ended or differential) and whose orientation represents the phase from 0° to 360° of this AC voltage.

For the construction of an autotransformer capable of producing nine phases starting from three phases separated by 120°, vector compositions are sought which, starting from the three initial phases, allow the nine desired phases to be fabricated.

The vectors used in this composition are obtained, on the one hand, from points representing the main or auxiliary winding terminals and, on the other, from points representing intermediate taps of these windings. The voltage obtained between two intermediate taps of a main winding is in phase with the voltage of the main winding (the vectors are therefore co-linear); its amplitude is a fraction of the voltage across the terminals of the main winding, this fraction being a function of the ratio between the number of winding turns situated between the intermediate taps and the total number of turns in the main winding; the relative length of the vector representing the voltage between two intermediate taps of a winding is determined by this ratio of number of turns.

According to the same principle, the voltage obtained across the terminals of an auxiliary winding associated with the main winding (in other words that has the same magnetic flux flowing through it and hence is wound at the same location on the same magnetic branch) is in phase with the voltage across the terminals of the main winding (the vectors are therefore parallel) and its amplitude is also determined by the ratio between the number of turns in the auxiliary winding and the number of turns in the main winding; the length of the vector representing the voltage in the auxiliary winding is therefore relative to the length of the vector representing the voltage on the main winding, in the ratio of the number of turns.

In this patent application, the term 'main winding' will be used to denote a winding having two ends and intermediate taps, but this terminology does not however signify that the main winding is necessarily a primary winding of the autotransformer. Indeed, in certain embodiments (step-down transformer) the main winding will effectively be a primary winding in the sense that it is supplied directly by a voltage to be converted; but in other embodiments (step-up transformer) the main winding will not be a primary winding since the three-phase supply to be converted will not be applied across the terminals of this winding.

Figure 2:
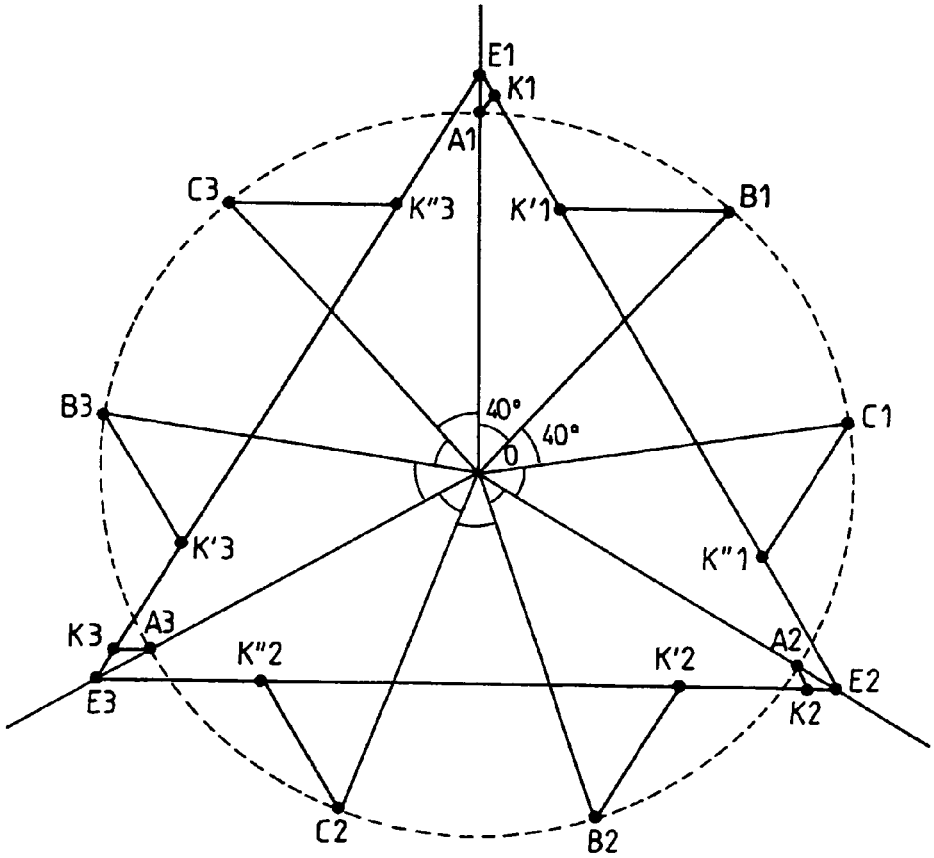
FIG. 2 shows a vector composition allowing the characteristics of a step-down autotransformer to be defined, in a first embodiment according to the invention.

FIG. 2 shows a vector composition that allows the present invention to be obtained, in the case of a step-down autotransformer. The three-phase supply of the autotransformer is applied at three input points E1, E2, E3 of the autotransformer and the three main windings B12, B23, B31 will be directly connected, in a delta configuration, between these three terminals: winding B12 between the terminals E1 and E2; winding B23 between the terminals E2 and E3; winding B31 between the terminals E3 and E1.

For convenience, in the following text, the same letters (for example E1 and E2) will at the same time denote the terminals of a winding (in the figures showing windings), and the ends of the vector representing the voltage across the terminals of this winding (in the figures showing the vector compositions).

The three-phase supply originates from an AC power distribution network at a frequency that depends on the applications. In the aircraft industry, where the invention is particularly appropriate because of their severe constraints on weight, dimensions and suppression of harmonics, the frequency is often 400 Hz and can also be 800 Hz.

A neutral point of origin O is arbitrarily defined for the vector composition, and the single-ended input and output voltages of the autotransformer will be referenced relative to this point. Thus, the vector OE1 represents the amplitude and the phase of the single-ended voltage present on the terminal E1 of the three-phase supply. The neutral point O is a virtual point (input and output via delta configuration) of the circuit; if the three-phase power supply applied at E1, E2, E3 is assumed to be well balanced, the neutral point represents the reference point where the vector sum of the voltages OE1, OE2, OE3 is zero. In the vector representation, the point O is the center of an equilateral triangle whose corners are at the points E1, E2, E3. The vectors OE2 and OE3, of the same amplitude as the vector OE1, are respectively oriented at +120° and −120° from the reference vector OE1. If the power supply applied to the terminals E1, E2, E3 is a three-phase supply in delta configuration (preferred case), the vectors E1E2, E2E3, E3E1 represent the amplitudes and phases of the voltages between power supply lines, applied across the terminals of the primary windings. They are at 120° from one another. In order to simplify the vector notation, in all the text that follows, the first letter of a vector is considered as the origin of the vector and the second letter is the arrival point of the vector; thus, OE1 represents the vector starting from O and going as far as E1 and not the reverse.

In FIG. 2, the phase of the single-ended voltage OE1 (vertical direction) has been chosen as phase reference. The direction of the vector E1E2 is at +150°; that of the vector E2E3 is at +270°; and that of the vector E3E1 is at +30°.

The vector composition in FIG. 2 allows nine voltages to be fabricated with phases at 40° from one another and with identical amplitudes, lower than that of the supply three-phase voltage.

According to the invention, three of the nine phases are aligned with the phases OE1, OE2, OE3 of the three-phase supply of the autotransformer.

With a starting assumption of a coefficient k representing the ratio between the value Va' of the voltage of the nine phases and the value Va of the input voltage (single-ended OE1, OE2, OE3), the following procedure is adopted: starting from the neutral point O, three systems of three vectors are traced with the same amplitude Va' equal to the amplitude of OE1 multiplied by the reduction ratio k:

$$Va' = Va * k$$

It should be noted that k is less than 1 and may be as low as 0.56.

The vectors of the first system define three points A1, A2 and A3 on the circle with center O and with radius Va'=k*Va. The vectors OA1, OA2, OA3 are aligned with the vectors OE1, OE2, OE3, respectively, and are therefore separated by 120° from one another. The vectors of the second system define three points B1, B2, B3 on the same circle with center O and with radius Va'. The vectors OB1, OB2, OB3 can be deduced from the vectors OA1, OA2, OA3 by a +40° rotation. Finally, the vectors of the third system, OC1, OC2, OC3, can be deduced from the vectors OB1, OB2, OB3 by another rotation of +40° (it could also be said that the vectors of the third system may be deduced from the vectors OA1, OA2, OA3 by a rotation of −40°, which amounts to strictly the same thing by inverting the designations C1 and C3)

The result is therefore nine vectors separated by 40° and having an amplitude Va'=k*Va.

On the vector E1E2, three intermediate points K1, K'1, K"1 are defined that physically form intermediate taps of the main winding B12.

The point K1 is the point of intersection between the vector E1E2 and a straight line passing through the point A1 and parallel to the vector E3E1. It will be seen that, in another possible embodiment, the straight line passing through A1 is drawn parallel to the vector E2E3 rather than E3E1.

The point K'1 is the point of intersection of the vector E1E2 with a straight line passing through the point B1 and drawn parallel to the vector E2E3.

Lastly, the point K"1 is the point of intersection of the vector E1E2 with a straight line passing through the point C1 and drawn parallel to the vector E3E1.

In the same way, repeating the operations by circular permutation, intermediate taps K2 (intersection with a straight line passing through A2 and parallel to E1E2), K'2 (intersection with a straight line passing through B2 and parallel to E3E1), and K"2 (intersection with a straight line passing through C2 and parallel to E1E2) are found on the vector E2E3.

Again in a similar manner, the same operations are repeated in order to determine the intermediate taps K3, K'3, K"3 on the vector E3E1.

On this construction, or by making a trigonometric calculation which is too tedious to reproduce here and which is trivial since all the angles are known as well as the respective lengths of OA1 and OE1, the lengths of the vectors E1K1, A1K1, E1K'1, B1K'1, K"1C1 and E1K"1 are measured. The lengths of the other vectors, obtained by circular permutation, are clearly identical.

These lengths, referenced to the length of the vector E1E2, will define numbers of turns in windings referenced to the total number N of turns in the primary winding.

Thus, the intermediate tap K1 in the main winding B12 is at a position such that the ratio n1/N between the number n1 of turns located between E1 and K1 and the total number N of turns in the primary winding B12 is:

$$n1/N=E1K1/E1E2$$

Similarly, the intermediate taps K'1 and K"1 are placed in positions such that the ratio between the number n'1 of turns situated between E1 and K'1 and the total number N of turns is:

$$n'1/N=E1K'1/E1E2$$

and the ratio between the number of turns n"1 situated between E1 and K"1 and the total number of turns N is:

$$n''1/N=E1K''1/E1E2.$$

The points A1, B1 and C1 are determined starting from the vectors K1A1, K'1B1 and K"1C1 whose orientations are not those of the vector E1E2. The voltages corresponding to these vectors will therefore be defined using auxiliary windings; the auxiliary windings are placed on the other two magnetic branches M23 and M31 of the magnetic circuit. These windings will have a first end connected to an intermediate tap, K1, K'1 or K"1, respectively, of the main winding B12 and a second end which will form an output A1, B1 or C1, respectively, of the autotransformer.

Thus, an auxiliary winding placed on the third branch M31 of the magnetic circuit (that carrying the third primary winding B31 connected between E3 and E1) will be used to establish a voltage represented by the vector K1A1 since this vector is parallel to the vector E3E1. This winding will have one end connected to the tap K1 and its other end will form an output terminal A1 of the autotransformer. Similarly, an auxiliary winding placed on the second branch of the magnetic circuit (that carrying the second main winding B23 connected between E2 and E3) will be used to establish a voltage represented by the vector K'1B1 since the vector K'1B1 is parallel to E2E3. This winding will have one end connected to the tap K'1 and its other end will form a second output B1 of the autotransformer, phase-shifted with respect to the output A1 by 40°. Again in a similar manner, an auxiliary winding placed on the third magnetic branch M31 (that carrying the main winding B31 connected between E3 and E1) will be used to establish the voltage K"1C1. This winding will have one end connected to the intermediate tap K"1 and another end defining a third output C1 phase-shifted by 40° with respect to the second.

The other outputs A2, B2, C2 then the outputs A3, B3, C3 are formed following the same principle, by circular permutation.

Figure 3:
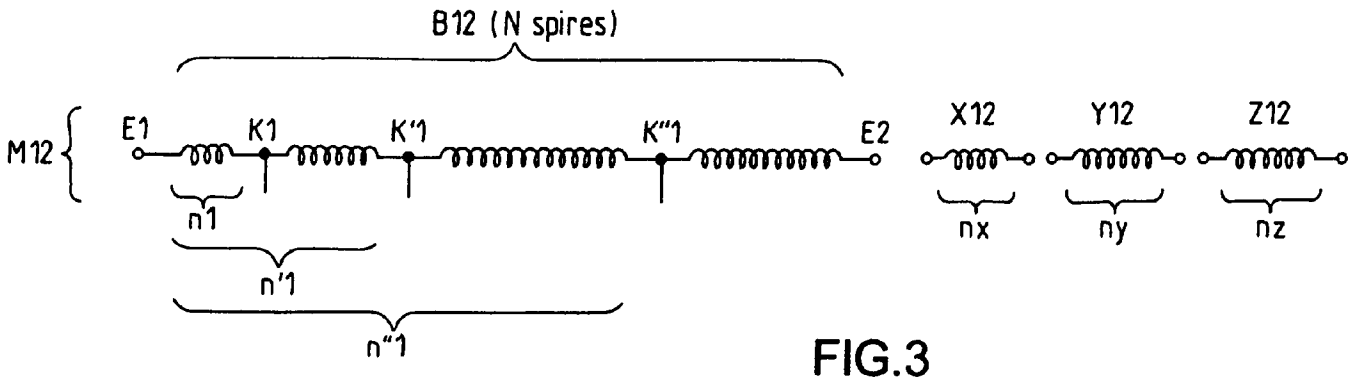
FIG. 3 shows the windings provided on one magnetic branch of the autotransformer.

FIG. 3 shows the windings situated on the first branch M12 of the magnetic circuit: the main winding B12 situated between the input terminals E1 and E2, with its intermediate taps K1, K'1 and K"1; and three auxiliary windings X12, Y12 and Z12, which are situated on the same magnetic branch M12 as the main winding B12 and have the same magnetic flux flowing through them, but which are not directly connected to the main winding B12. These auxiliary windings X12, Y12, Z12 produce the voltages represented by the vectors K2A2, K'3B3 and K"2C2 which must all be in phase (or in phase opposition) with the voltage on the main winding B12. These windings are therefore each connected between an intermediate tap K2, K'3 or K"2 of the main windings B23 and B31 and a respective output A2, B3 or C2 of the autotransformer.

The numbers of turns nx, ny and nz in these three windings X12, Y12 and Z12 are calculated relative to the number N of turns in the main winding as a function of the length of these three vectors:

$$nx/N=K2A2/E1E2$$

$$ny/N=K'3B3/E1E2$$

$$nz/N=K''2C2/E1E2$$

In the same manner, the second magnetic branch M23 of the autotransformer comprises a main winding B23 connected between the terminals E2 and E3, with its intermediate taps K2, K'2, K"2 and three secondary windings X23, Y23, Z23 designed to produce the voltages of vectors K3A3, K'1B1 and K"3C3 in phase or in phase opposition with the supply voltage applied to the main winding B23 situated between E2 and E3. The numbers of turns in X23, Y23, Z23 are again nx, ny and nz. The numbers of turns n2, n'2, n"2 which define the intermediate taps are the same as the numbers n1, n'1, n"1.

And lastly, the same description can be presented for the third magnetic branch M31 with its main winding B31 having N turns and its intermediate taps K3, K'3, K"3 with numbers of turns n3, n'3, n"3 that are identical to the numbers n1, n'1, n"1 and n2, n'2, n"2. It also has three independent secondary windings X31, Y31, Z31 situated on the same magnetic branch in order to produce, by way of the numbers of turns nx, ny and nz, the voltages represented by the vectors K"1C1, K'2B2 and K1A1.

It will be noted that, for high-power converters (several tens, or even several hundreds of kVA), the number of turns is greatly reduced and only integer numbers of turns, or sometimes integer numbers of half-turns, are used. This is why the theoretical number of turns, which depends on the ratio k between output voltage and input voltage, must be rounded to the higher or lower integer unit or half-unit. Moreover, given that the vector composition yields slightly different angles and lengths depending on whether the autotransformer is normally loaded or is unloaded, the choice of the number of turns (higher or lower value) can be adjusted in order to approximate as closely as possible to the theory, either with no load, with full load or with an intermediate load.

Typically, for a 150 kVA autotransformer, with a transformation ratio k=1/1.14, the number of turns N can be 73 turns, n1, n2, n3 can be 3 turns, n'1, n'2, n'3 around 15 turns, n"1, n"2, n"3 around 60 turns, nx equal to n1, 3 turns, ny and nz equal to around 15 turns. These numbers are given by way of example.

Figure 4:
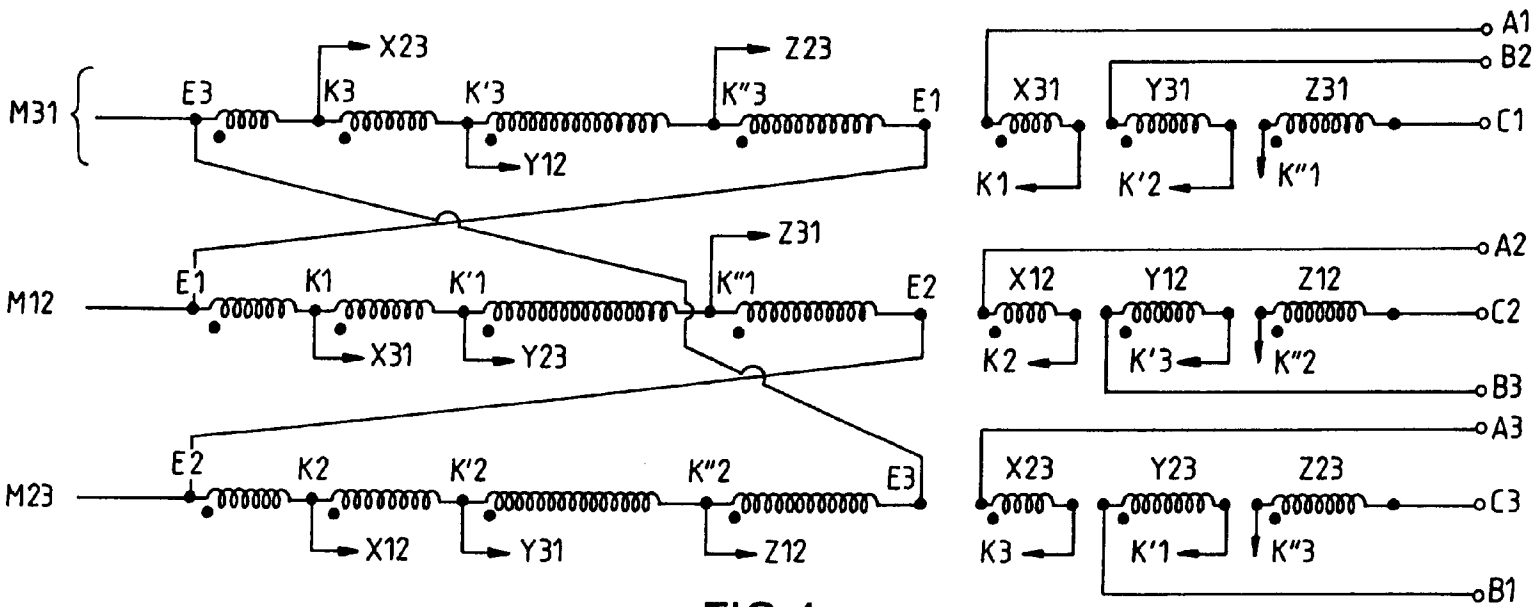
FIG. 4 shows the configuration of the autotransformer corresponding to the vector composition in FIG. 2.

FIG. 4 shows the three magnetic branches with their respective sets of main and secondary windings, and this time with the connections that fully establish the desired voltage amplitudes and phases allowing the outputs A1, B1, C1, A2, B2, C2, A3, B3, C3 to represent a nine-phase system having the desired amplitude Va' and which is capable of directly supplying a system of three rectifier bridges with 6 diodes each. In FIG. 4, in order to take into account the question of relative winding sense of the windings, all the turns are considered to be wound in the same direction of rotation when going from the left toward the right and for this reason, for example, the intermediate tap K1 is connected to the right-hand winding terminal X31, the output A1 being the left-hand terminal, since the vector K1A1 must be oriented in the reverse direction to the vector E3E1 (hence A1K1 oriented in the same direction as E3E1).

Possible modification of the diagram in FIG. 2:

The diagram in FIG. 4 and the vector diagram in FIG. 2 may be modified in the sense that the winding that produces the voltage phase-shifted by +40° at B1 could be a winding of the branch M31 rather than a winding of the branch M23 and, conversely, the winding that produces the voltage phase-shifted by −40° at C1 would be on the branch M23 rather than M31. In this case, the number of turns in this winding and especially the position of the intermediate taps K'1 and K"1 would be changed since the point K'1 would now be the intersection of a straight line parallel to E3E1, and not E2E3, with E1E2; K"1 would be the intersection of E1E2 with a straight line parallel to E2E3.

Figure 5:
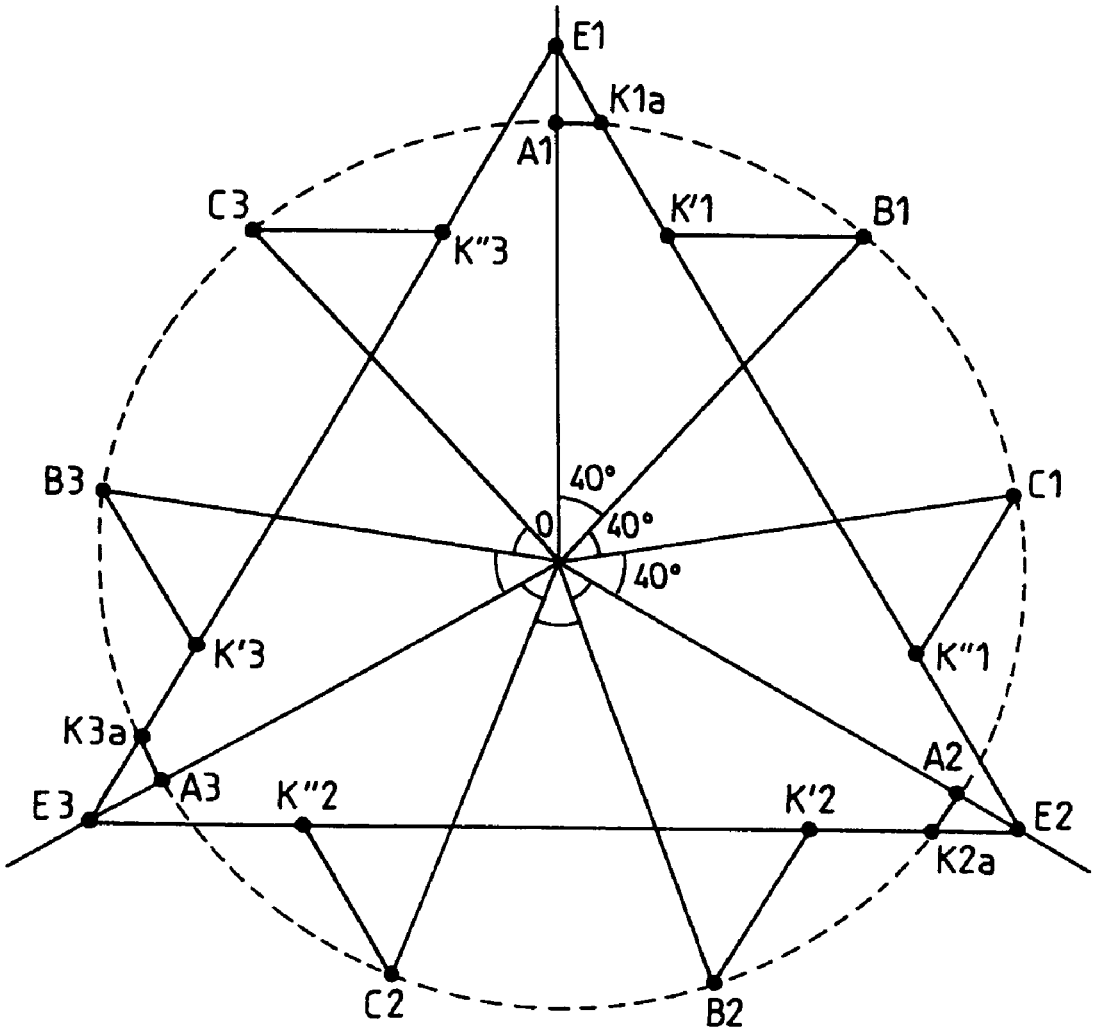
FIG. 5 shows the vector composition corresponding to a second embodiment.
Figure 6:
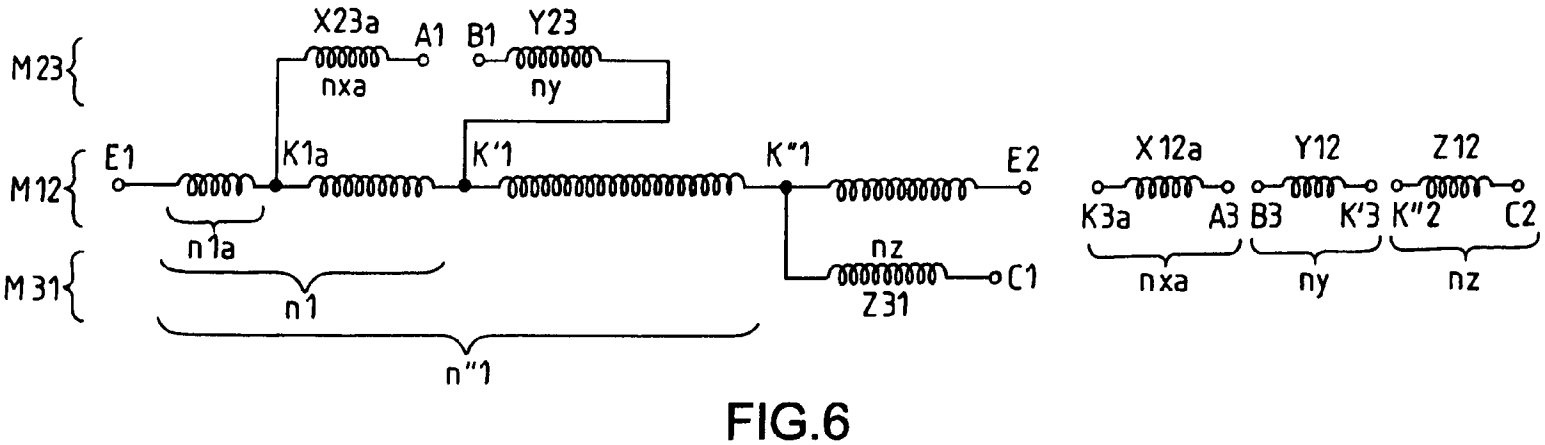
FIG. 6 shows the configuration of the windings of an autotransformer corresponding to the vector composition in FIG. 5.

Embodiment in FIGS. 5 and 6:

FIG. 5 shows, in the form of a vector composition, and FIG. 6 shows, in physical form, a variant in which the output voltage on the terminal A1 is obtained from a winding X23*a* wound on the magnetic branch M23 and connected to an intermediate tap K1*a* of the winding B12, and not by a winding X31 on the branch M31. The points A2 and A3 follow the same principle as the point A1, by circular permutation. The points B1, B2, B3, C1, C2, C3 are obtained in the same manner as in FIGS. 2 and 4.

The winding X23*a*, disposed between the intermediate tap K1*a* of the primary winding B12 (between E1 and E2) and the output point A1, corresponds to a vector traced in the following manner: starting from the point A1 on the axis OE1 and such that OA1/OE1=k (k being the desired voltage reduction ratio), a line parallel to E2E3 is traced and this parallel line intersects the vector E1E2 at the point K1*a*. The measurement of E1K1*a* (or the trigonometric calculation) yields the number of turns n1*a* between E1 and the first intermediate tap K1*a* (the tap K1 in FIG. 2 no longer exists). The measurement of K1*a*A1 yields the number of turns nxa in the winding X23*a* which is used to establish this vector. The vectors K'1B1 and K"C1 which give the points K'1 and K"1 are obtained in the same manner as in FIG. 2 and their measurement gives the position of the intermediate taps K'1 and K"1.

FIG. 6 shows, for the branch M12, the windings corresponding to this variant, with their connections: the main winding B12 between E1 and E2 comprises the intermediate taps K1*a*, K'1 and K"1. The winding X23*a*, with nxa turns, starts from the tap K1*a*, and the other end of this winding forms the output terminal A1 of the autotransformer. The winding X23*a* is wound on the magnetic branch M23 in the same sense as the main winding B23. A winding Y23, with ny turns wound on the branch M23, in the reverse sense to the winding B23, starts from the point K'1, and the other end of this winding Y23 forms the output terminal B1. The winding Z31, wound on the branch M31 in the same sense as the main winding B31, starts from the point K"1 and its end forms the output terminal C1. The output terminals A2, B2, C2 are obtained from the other main and auxiliary windings by circular permutation. As was explained in relation to the construction in FIG. 2, the points B1 and C1 could be obtained starting from windings Y31 and Z23 rather than Y23 and Z31, the taps K'1 and K"1 not then being in the same locations.

It will be noted that, depending on the value of the desired voltage reduction ratio k, the point K1*a* may be situated between the terminal E1 and the terminal K'1 (case of FIG. 5, for k relatively close to 1) or between the terminal K'1 and the terminal E2 (k less than about ⅔).

The embodiment in FIGS. 5 and 6 have a significant advantage in terms of control of the leakage fluxes. This results from the fact that, for the same voltage reduction coefficient k, the length of the vector E1K1*a* in FIG. 5 is greater than that of the vector E1K1 in FIG. 2.

Possible modification of FIGS. 2 and 5 by means of a vector that is symmetrical to the vector K1A1 or K1*a*A1:

It will be noted that the output A1 may be obtained starting from a vector that is symmetrical to the vector K1A1 (or K1*a*A1) with respect to the axis OE1. This amounts to the same thing, but, depending on the physical constitution of the windings on the magnetic cores, this may facilitate the connections between windings (in the winding connections of power autotransformers, crossing-over of connections must be avoided and the shortest possible connections must be used). In this case, the point K1, used as starting point for an auxiliary winding for producing a voltage on the terminal A1 in phase with the terminal E1, would be replaced by an intermediate tap of the winding B31 (between E3 and E1, but close to E1). The auxiliary winding going from this tap (K1*s*, not shown) toward the point A1 would be a winding on the branch M12 of the magnetic core, wound in the same sense as the winding connected between E1 and E2. Or alternatively, starting from another intermediate tap (K1*as*, not shown) on the winding B31, close to the terminal E1 and symmetric with the point K1*a* with respect to the straight line OE1, an auxiliary winding would be connected that is wound on the branch M23 from A1 toward K1*as* in the same sense as the main winding B23 connected between E2 and E3.

Possible modification of FIGS. 2 and 5 with two windings arriving at the same output terminal A1:

In one advantageous embodiment, there may even be provided both an intermediate tap K1 on the main winding B12 (close to E1) and an intermediate tap K1*s*, symmetric with K1 with respect to the line OA1, on the main winding B31 (also close to E1), and two auxiliary windings starting respectively from these two points K1 and K1*s* and arriving at the same terminal A1, one of these windings being on the branch M31 and the other on the branch M12. Similarly, the diagram in FIG. 5 could be improved with two symmetrical windings, one starting from the tap K1*a* on the main winding B12 (close to E1) and the other starting from a symmetrical point K1*as*, placed on B31 and close to E1, these two windings, wound on the branch M23, arriving at the same terminal A1.

In other words, if two main windings (B12, B31) connected to the same common terminal (E1) and the first intermediate tap (K1 or K1*a*) provided on one of them are considered, a fourth intermediate tap (K1*s* or K1*as*) is also provided situated on the other, with the same number of turns, on the one hand, between the common terminal (E1) and said first intermediate tap (K1 or K1*a*) and, on the other, between the common terminal (E1) and said fourth intermediate tap (K1*s* or K1*as*); starting from these two intermediate taps (K1 and K1*s*, or else K1*a* and K1*as*), two auxiliary windings are connected that are both connected to the terminal that is in phase with the voltage on the common terminal E1, in other words the output terminal A1.

The embodiments that have just been described, with two auxiliary windings arriving at the same output terminal A1, are perfectly symmetrical and balanced. Indeed, what has just been said for the terminal A1 is of course also applied to the terminals A2 and A3.

Figure 7:
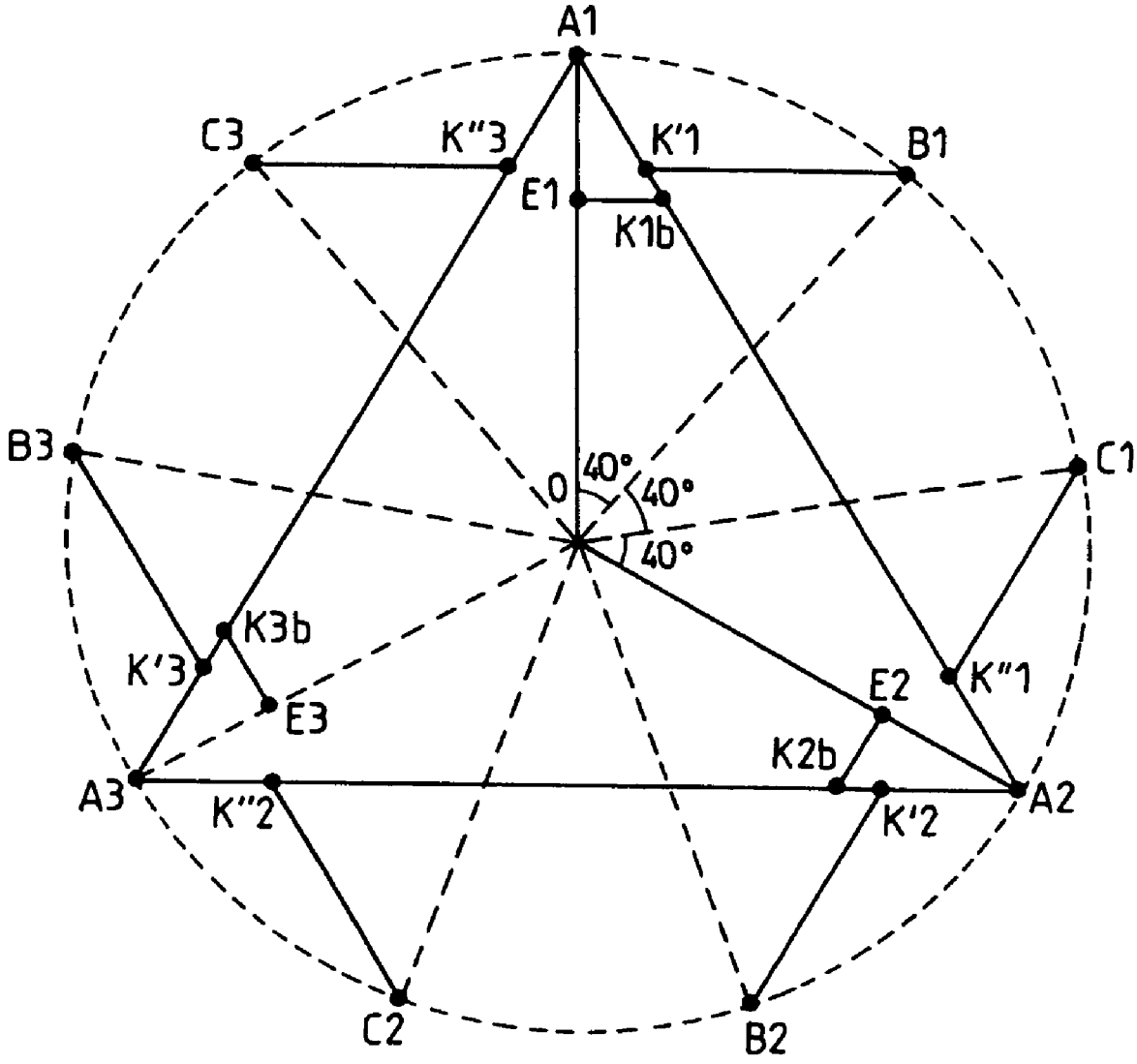
FIG. 7 shows the vector composition corresponding to a third embodiment, for a step-up autotransformer.

FIG. 7 shows another embodiment variant, designed to raise the voltage on the nine phases with respect to the value of the supply three-phase voltage. The ratio k is, in this case, greater than 1.

The main windings which are used in the construction and which comprise intermediate taps are no longer the primary windings of the transformer, in other words they are not connected across the input terminals E1, E2, E3 of the transformer.

The vector construction is the following: the vectors OE1, OE2, OE3 are traced at 120° from one another, representing the three-phase supply, the terminals E1, E2, E3 being the inputs of the transformer. The vector OE1 is extended as far as a point A1 such that OA1/OE1=k. A2 and A3 are obtained in the same manner. The terminals A1, A2, A3 form three first output terminals (direct outputs) of the autotransformer.

The points B1, B2, B3 (outputs phase-shifted by +40°) on the circle with center O and with radius OA1 are determined, such that OB1, OB2, OB3 are phase-shifted by +40° relative to OA1, OA2, OA3. The points C1, C2, C3 (outputs phase-shifted by +80°) are also determined on the same circle, such that OC1, OC2, OC3 are phase-shifted by +80° relative to OA1, OA2, OA3.

From the point E1, either a straight line parallel to A3A1 is traced in order to determine a point of intersection K1 on the vector A1A2 (as the point K1 was sought on E1E2 in FIG. 2), or, preferably, a line parallel to A3A2 in order to determine a point of intersection K1*b* on the vector A1A2 (as the point K1*a* was sought on E1E2 in FIG. 5). In FIG. 7, this second solution is the one adopted.

From the point B1, a straight line parallel to A2A3 is traced in order to find the point K'1 (intersection with A1A2), and from the point C1, a line parallel to A1A3 is traced in order to find the point K"1 (intersection with A1A2).

Figure 8:
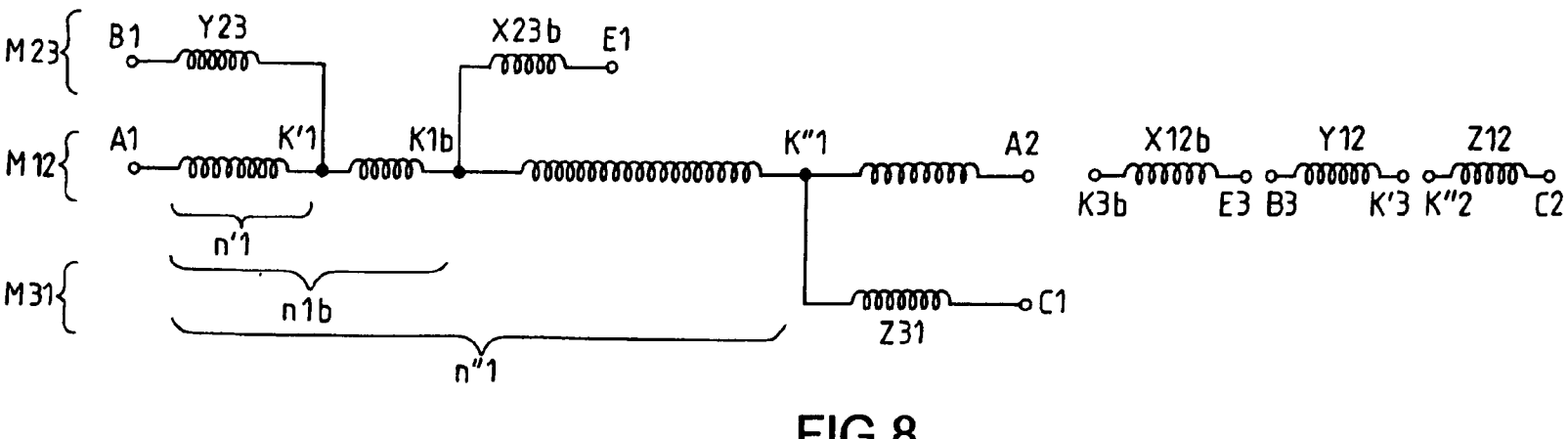
FIG. 8 shows the configuration of the windings of an autotransformer corresponding to the vector composition in FIG. 7.

The autotransformer is formed using this vector construction as it is shown in FIG. 8 and using the following windings:

main winding B12 on one magnetic branch M12, this winding being connected between the outputs A1 and A2, with intermediate taps K'1, K1*b*, K"1; and main windings not shown B23 on the branch M23 between A2 and A3 and B31 on the branch M31 between A3 and A1; with intermediate taps K'2, K2*b* and K"2 on B23 and K'3, K3*b* and K"3 on B31, respectively;

auxiliary windings X23*b* on the branch M23, connected between the tap K1*b* and the input E1 of the autotransformer, this winding being wound in the same sense, going from K1*b* toward E1, as the main winding B23 going from A2 toward A3; and, similarly, auxiliary windings not shown X31*b* on the branch M31 and X12B on the branch B12;

auxiliary winding Y23 on the branch M23, going from the tap K'1 to the output B1 of the autotransformer; this winding is wound from B1 toward K'1 in the same sense as the winding B23; and, similarly, windings not shown Y31 on the branch M31, going from K'2 to B2, and Y12 on the branch M12, going from K'3 to B3;

auxiliary winding Z31 on the branch M31, going from K"1 to C1 and being wound in the same sense as B31; and, similarly, windings not shown Z12 on the branch M12, from K"2 to C2, and Z23 on the branch M23, from K"3 to C3.

FIG. 8 shows the configuration of the windings associated with the magnetic branch M12 and with the main winding B12 (between A1 and A2) of this branch; as in FIG. 6, the windings of the same magnetic branch are shown on the same line and adjacent to one another, whereas in practice they are wound on top of one another, or even interlaced with one another.

The step-up autotransformer in FIGS. 7 and 8 (k>1) operates by applying a three-phase voltage to the inputs E1, E2, E3 and receiving on the direct outputs A1, A2, A3 the outputs phase-shifted by +40° B1, B2, B3 and the outputs phase-shifted by −40° C3, C2, C1, a nine-phase voltage of amplitude k times higher than the original three-phase voltage.

As was done in relation to FIG. 2 and FIG. 5, FIG. 7 could also be modified; the most advantageous modification consists in connecting, rather than a single auxiliary winding from the intermediate tap K'1*b* toward the terminal E1, two windings with symmetrical vectors with respect to the line OA1. For this purpose, a fourth intermediate tap (K1*bs*, not shown) is provided in FIG. 7 on the main winding B23, at a distance (in other words a number of turns) from the terminal A1 which is the same as the distance between A1 and K1*b*. An auxiliary winding wound on the branch M23 starts from this fourth intermediate tap K1*bs*, that is symmetric with the winding X23*b* and also arriving at the input terminal E1.

In other words, if two main windings (A12, A31) connected to the same common terminal (A1) and the first intermediate tap (K1*b*) provided on one of them are considered, then a fourth intermediate tap (K1*bs*) is provided situated on the other, with the same number of turns, on the one hand, between the common terminal (A1) and the first intermediate tap (K1*b*) and, on the other, between said fourth intermediate tap (K1*bs*) and the common terminal; starting from these two intermediate taps (K1*b* and K1*bs*), two auxiliary windings are connected which are both connected to the terminal (E1) that is in phase with the voltage on the common terminal A1; here, the terminal E1 is an input terminal.

Whether the autotransformer is a step-up or step-down transformer, it can be directly used to form an AC/DC voltage converter.

Figure 9:
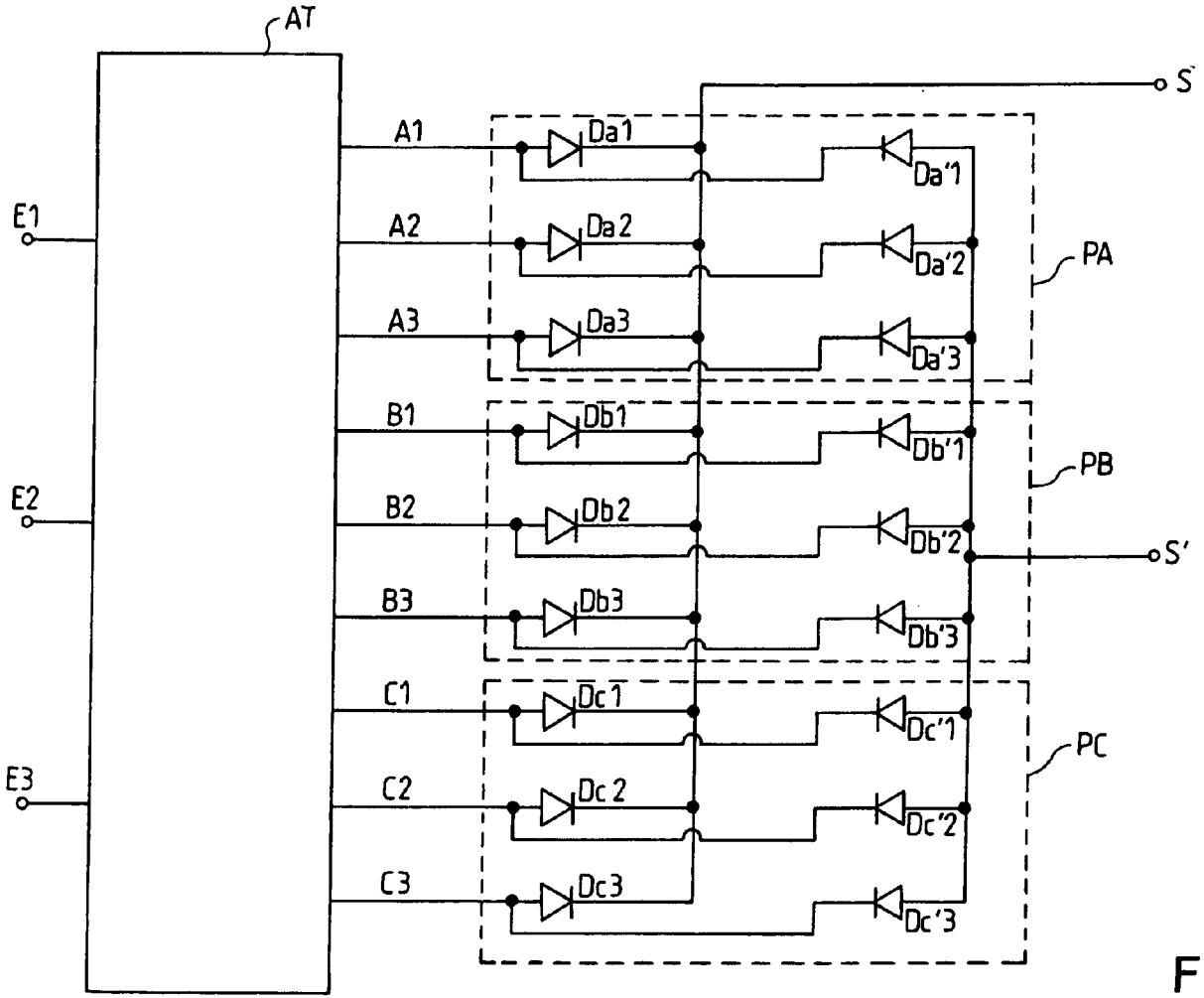
FIG. 9 shows an AC/DC converter employing the autotransformer.

For this purpose, as is shown in FIG. 9, the three-phase supply is connected to the inputs E1, E2 and E3 and the outputs of the autotransformer AT are connected to a triple rectifier bridge with three times six diodes.

The direct outputs (A1, A2, A3) are connected to a first bridge PA with six diodes Da1, Da2, Da3, Da'1, Da'2, Da'3. The outputs phase-shifted by +40° are connected to a second bridge PB with six diodes Db1, Db2, Db3, Db'1, Db'2, Db'3. The outputs phase-shifted by −40° are connected to a third bridge PC with six diodes Dc1, Dc2, Dc3, Dc'1, Dc'2, Dc'3.

The three rectifier bridges have common outputs S and S' which form the outputs of the converter.

The diode Da1 is connected in forward-biased configuration between the output A1 and a positive terminal S forming one of the two DC output terminals of the converter. The diode Da'1 is connected in reverse-biased configuration between the output A1 and a negative terminal S' forming the other DC output terminal of the converter.

The same connection scheme is used for all the other diodes: the diode Da2 and the diode Da'2 are respectively forward- and reverse-biased between A1, on the one hand, and S and S', respectively, on the other. The diode Db1 and the diode Bb'1 are respectively forward- and reverse-biased between B1, on the one hand, and S and S', respectively, on the other, and so on; one diode in forward-biased configuration is connected between one output terminal of the autotransformer and the terminal S and one diode in reverse-biased configuration is connected reverse-biased between this output terminal and the terminal S'.

It is not necessary to insert inter-phase chokes between the common outputs of a group of three diodes in forward-biased configuration (for example Da1, Da2, Da3) and the terminal S or between the common outputs of a group of three reverse-biased diodes (Da'1, Da'2, Da'3) and S'.

The invention claimed is:

1. A step-up or step-down autotransformer, designed to be connected to a supply of three-phase voltage of given amplitude and supplying nine output voltages with phases separated in steps of 40° and of identical amplitudes, higher or lower than the amplitude between neutral and phase of the three-phase supply, the autotransformer comprising:

a magnetic core with three branches and on each magnetic branch a main winding having a first and second terminal three main windings being electrically connected together in delta configuration, wherein the autotransformer also comprises, on each magnetic branch, three auxiliary windings, the main winding of a given branch having between its first and its second terminal, a first, a second and a third intermediate tap, the first auxiliary winding of another branch having a first terminal connected, respectively, to a first intermediate tap of the main winding of the given branch and a second input or output terminal having a voltage in phase with the voltage present on the first terminal of this main winding, the second and third auxiliary windings of the given branch each having a first terminal connected to a second or a third intermediate tap of one or the other of the other branches and a second terminal forming a respective output among nine outputs of the autotransformer.

2. The autotransformer as claimed in claim 1, wherein the first auxiliary winding of the first branch is connected to the first intermediate tap of the main winding of a second branch, the first terminal of the main winding of the second branch being connected to the second terminal of the main winding of the first branch.

3. The autotransformer as claimed in claim 1, wherein it forms a step-down autotransformer, the first and second terminals of the main windings being inputs of the autotransformer, designed to be supplied by the three-phase voltage to be transformed, and the second terminal of the first auxiliary winding of one branch forming a direct output of the autotransformer, in phase with a voltage on one terminal of the three-phase supply.

4. The autotransformer as claimed in claim 2, wherein it forms a step-down autotransformer, the first and second terminals of the main windings being inputs of the autotransformer, designed to be supplied by the three-phase voltage to be transformed, and the second terminal of the first auxiliary winding of one branch forming a direct output of the autotransformer, in phase with a voltage on one terminal of the three-phase supply.

5. The autotransformer as claimed in claim 3, wherein two main windings mounted on two different magnetic branches are connected to one input of the autotransformer, the auxiliary winding which is connected to the direct output in phase with the three-phase voltage present at this input being mounted on the third magnetic branch.

6. The autotransformer as claimed in claim 4, wherein two main windings mounted on two different magnetic branches are connected to one input of the autotransformer, the auxiliary winding which is connected to the direct output in phase with the three-phase voltage present at this input being mounted on the third magnetic branch.

7. The autotransformer as claimed in claim 1, wherein it forms a step-up autotransformer, the first and second terminals of the main windings being direct outputs of the autotransformer, in phase with the voltages of the three-phase supply, and the second terminal of the first auxiliary winding of each branch forming a respective input of the three-phase supply.

8. The autotransformer as claimed in claim 2, wherein it forms a step-up autotransformer, the first and second terminals of the main windings being direct outputs of the autotransformer, in phase with the voltages of the three-phase supply, and the second terminal of the first auxiliary winding of each branch forming a respective input of the three-phase supply.

9. The autotransformer as claimed in claim 7, wherein, two main windings, mounted on two different magnetic branches, being connected to the same direct output of the autotransformer in the delta configuration, the auxiliary winding connected to one input n phase with this output is mounted on the third magnetic branch.

10. The autotransformer as claimed in claim 8, wherein, two main windings, mounted on two different magnetic branches, being connected to the same direct output of the autotransformer in the delta configuration, the auxiliary winding connected to one input n phase with this output is mounted on the third magnetic branch.

11. The autotransformer as claimed in claim 1, wherein the first intermediate tap of a main winding is situated between a first terminal of this main winding and the second intermediate tap.

12. The autotransformer as claimed in claim 1, wherein the first intermediate tap of a main winding is situated between the second and third intermediate taps of this winding.

13. The autotransformer as claimed in claim 1, wherein, if two main windings connected to the same common terminal and the first intermediate tap provided on one of said two main windings are considered, a fourth intermediate tap is also provided situated on the other of said two main windings, with the same number of turns, on the one hand, between the common terminal and said first intermediate tap and, on the other hand, between the common terminal and said fourth intermediate tap, and, starting from these two intermediate taps, two auxiliary windings connected to said second input or output terminal which is in phase with the voltage on the common terminal.

14. An AC/DC converter comprising an autotransformer as claimed in claim 1, a forward-biased diode being connected between each output of the autotransformer and a positive output of the converter and a reverse-biased diode being connected between each output of the autotransformer and a negative output of the converter.

15. An AC/DC converter comprising an autotransformer as claimed in claim 2, a forward-biased diode being connected between each output of the autotransformer and a positive output of the converter and a reverse-biased diode being connected between each output of the autotransformer and a negative output of the converter.

16. An AC/DC converter comprising an autotransformer as claimed in claim 3, a forward-biased diode being connected between each output of the autotransformer and a positive output of the converter and a reverse-biased diode being connected between each output of the autotransformer and a negative output of the converter.

17. An AC/DC converter comprising an autotransformer as claimed in claim 7, a forward-biased diode being connected between each output of the autotransformer and a positive output of the converter and a reverse-biased diode being connected between each output of the autotransformer and a negative output of the converter.

18. An AC/DC converter comprising an autotransformer as claimed in claim 2, a forward-biased diode being connected between each output of the autotransformer and a positive output of the converter and a reverse-biased diode being connected between each output of the autotransformer and a negative output of the converter.

19. An AC/DC converter comprising an autotransformer as claimed in claim 12, a forward-biased diode being connected between each output of the autotransformer and a positive output of the converter and a reverse-biased diode being connected between each output of the autotransformer and a negative output of the converter.

20. An AC/DC converter comprising an autotransformer as claimed in claim 13, a forward-biased diode being connected between each output of the autotransformer and a positive output of the converter and a reverse-biased diode being connected between each output of the autotransformer and a negative output of the converter.

* * * * *